US011367979B1

(12) United States Patent
Huang

(10) Patent No.: US 11,367,979 B1
(45) Date of Patent: Jun. 21, 2022

(54) TERMINAL COMPONENTS OF CONNECTOR AND CONNECTOR STRUCTURE

(71) Applicant: Industrial Technology Research Institute, Hsinchu (TW)

(72) Inventor: Tien-Fu Huang, Hsinchu County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 17/134,641

(22) Filed: Dec. 28, 2020

(51) Int. Cl.
*H01R 13/6474* (2011.01)
*H01R 12/72* (2011.01)

(52) U.S. Cl.
CPC ..... *H01R 13/6474* (2013.01); *H01R 12/721* (2013.01)

(58) Field of Classification Search
CPC ..... H01R 13/6474; H01R 12/721
USPC ..... 439/630
See application file for complete search history.

(56) References Cited

U.S. PATENT DOCUMENTS

| | | | | |
|---|---|---|---|---|
| 6,517,382 | B2 | 2/2003 | Flickinger et al. | |
| 6,524,134 | B2 | 2/2003 | Flickinger et al. | |
| 6,749,448 | B2 | 6/2004 | Bright et al. | |
| 6,816,376 | B2 | 11/2004 | Bright et al. | |
| 7,070,446 | B2 | 7/2006 | Henry et al. | |
| 7,074,082 | B2 | 7/2006 | Kerlin et al. | |
| 7,303,438 | B2 | 12/2007 | Dawiedczyk et al. | |
| 7,448,897 | B2 | 11/2008 | Dawiedczyk et al. | |
| RE43,427 | E | 5/2012 | Dawiedczyk et al. | |
| 8,292,669 | B2 | 10/2012 | Wang et al. | |
| 8,353,707 | B2 | 1/2013 | Wang et al. | |
| 8,672,713 | B2 * | 3/2014 | Tajiri | H01R 12/585 439/630 |
| 9,608,349 | B2 * | 3/2017 | Mashiyama | H01R 13/2457 |
| 9,843,119 | B1 | 12/2017 | Chen | |
| 9,899,759 | B2 * | 2/2018 | Yu | H01R 13/428 |
| 9,966,679 | B2 * | 5/2018 | Xu | H01R 12/737 |
| 10,185,100 | B2 | 1/2019 | Takano et al. | |
| 10,637,175 | B1 * | 4/2020 | Zou | H01R 12/7088 |

(Continued)

FOREIGN PATENT DOCUMENTS

| | | |
|---|---|---|
| CN | 202121104 U | 1/2012 |
| CN | 202217817 U | 5/2012 |

(Continued)

OTHER PUBLICATIONS

TW OA dated May 10, 2021.

*Primary Examiner* — Peter G Leigh
(74) *Attorney, Agent, or Firm* — WPAT, PC

(57) ABSTRACT

A connector structure is provided. The connector structure includes an insulated housing and at least one terminal assembly. The terminal assembly includes an insulated shelter and at least one pins. The pins are connected to and penetrated through the insulated shelter. The pin includes a pin body and at least two protrusive portions. Each protrusive portion is connected to the pin body, and in a length direction of the pin body, the protrusive portions respectively extend corresponding contact portions. The contact portion is in contact with a corresponding signal pad of a circuit board, and the contact portions are at different positions of the signal pad. In additional, a terminal components of connector is also provided.

7 Claims, 8 Drawing Sheets

(56) References Cited

U.S. PATENT DOCUMENTS

| | | | | |
|---|---|---|---|---|
| 2009/0209142 | A1* | 8/2009 | Sasaoka | H01R 12/716<br>439/862 |
| 2017/0358883 | A1 | 12/2017 | Chen | |
| 2018/0097320 | A1* | 4/2018 | Hashiguchi | H01R 24/60 |
| 2019/0393657 | A1* | 12/2019 | Hashiguchi | H01R 13/415 |
| 2020/0014150 | A1 | 1/2020 | Chen | |
| 2020/0036123 | A1* | 1/2020 | Cai | H01R 12/721 |

FOREIGN PATENT DOCUMENTS

| | | | | | |
|---|---|---|---|---|---|
| CN | 107742788 | A | | 2/2018 | |
| CN | 107994366 | A | | 5/2018 | |
| CN | 109314334 | A | | 2/2019 | |
| CN | 110474183 | A | | 11/2019 | |
| CN | 111193126 | A | | 5/2020 | |
| TW | 576572 | U | | 2/2004 | |
| TW | M281329 | | | 11/2005 | |
| TW | M424576 | | | 3/2012 | |
| TW | I515977 | B | * | 12/2012 | H01R 12/72 |
| TW | I515977 | | | 1/2016 | |

* cited by examiner

TERMINAL COMPONENTS OF CONNECTOR AND CONNECTOR STRUCTURE

TECHNICAL FIELD

The present disclosure relates in general to terminal components of a connector and a structure of the same connector.

BACKGROUND

Signal transmission within an electronic device is mainly achieved through a plurality of connectors. Generally speaking, a typical connector is consisted of an insulated housing and a plurality of metal pins. With the development of technology, the amount of information to be transmitted by electronic devices is increasing, and so it is inevitable to increase the frequency or rate of signal transmission.

Generally, the higher the frequency or rate of signal transmission of the connector is, more energy loss during the signal transmission, especially for high-frequency signal transmission, can be expected. Such an energy loss includes mainly a conductor loss and a dielectric loss. In addition, if the conductor for transmitting the high-frequency signals has an open (unsealed) end, then discontinuity of impedance at the open end would occur to lower signal integrity of the high-frequency signal transmission path. In the art, such a phenomenon is called as a stub effect.

Currently, it is known that a high-rate connector is accompanied with the stub effect, which is mainly caused from the matching of male and female structures thereof. In order to ensure a durable contact, while in matching the male structure to the female structure of the connector, a wiping operation is usually applied to pins of the pairing male and female connector structures. However, the wiping operation would, inherently to form an open end on at least one of the paired matching pins. As the male and female connector structures are matched to exchange high-frequency electronic signals, the open end of the pin would induce the stub effect to reduce transmission integrity of the high-frequency signals.

Thus, an improved terminal component of a connector and a structure for the same connector are definitely urgent to the skill in the art.

SUMMARY

An object of the present disclosure is to provide terminal components of a connector and a connector structure that can lower the stub effect in a signal transmission path, such that possible problems in signal energy loss during signal transmission can be improved, and the capability of the connector to transceive higher frequencies and the data rate thereof can be increased.

In one embodiment of this disclosure, a connector structure includes an insulated housing and at least one terminal assembly. The insulated housing includes at least one receiving groove for allowing a predetermined circuit board, a daughter board for example, to insert. The daughter board has a surface furnished thereon with a plurality of signal pads. Each of the at least one terminal assembly is at least partially disposed in the insulated housing. Each of the at least one terminal assembly includes an insulated shelter and a plurality of pins. The plurality of pins are fixed to the insulated shelter. Each of the plurality of pins includes a pin body and at least two protrusive portions. Each protrusive portions is connected to the pin body. The protrusive portions of a pin are to contact a corresponding signal pads on the daughter board at different positions.

In another embodiment of this disclosure, a terminal component of a connector to a daughter board having a surface furnished thereon with a plurality of signal pads includes an insulated shelter and a plurality of pins. The plurality of pins are fixed to the insulated shelter. Each of the plurality of pins includes a pin body and at least two protrusive portions. Each protrusive portions is connected with the pin body. The protrusive portions of a pin are to contact a predetermined signal pad on the daughter board at different positions.

In a further embodiment of this disclosure, a terminal component of a connector to a complement connector having a surface furnished thereon with a plurality of signal pads includes an insulated shelter and a plurality of pins. The plurality of pins are fixed to the insulated shelter. Each of the plurality of pins includes a pin body and at least two protrusive portions. Each of the at least two protrusive portions of a pin is connected with the pin body. The protrusive portions of a pin are to contact a predetermined signal pad on the complement connector at different positions.

As stated, in the terminal components of the connector and the same connector structure provided by this disclosure, one single pin provides multiple contact portions to a predetermined signal pad while the connector having the pin is matched with the daughter board or the complement connector. With two or three contact portions on a single pin, the open (unsealed) ends on the signal pad of the daughter board or the complement connector can be reduced or closed, such that the stub effect in the signal transmission path can be inhibited or reduced, the problem of energy loss during signal transmission can be resolved, and the transmission bandwidth and the data rate for the connector can be improved.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
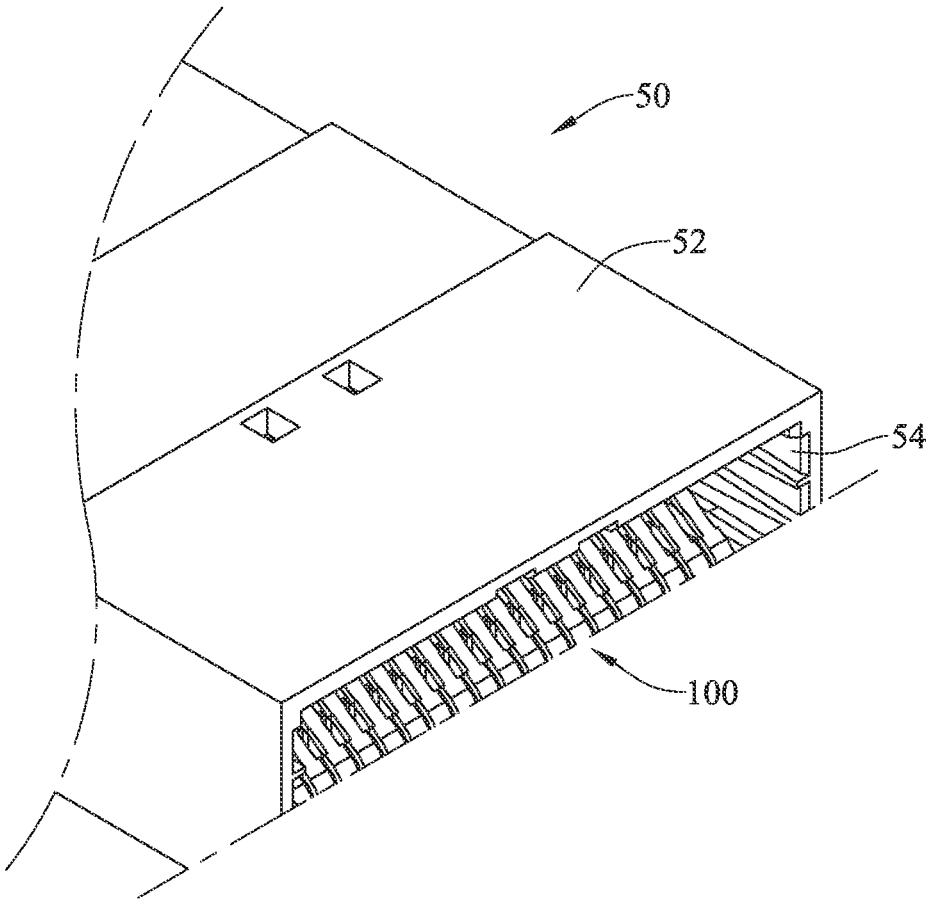
FIG. 1 is a schematic perspective view of a portion of the connector structure in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

It shall be explained that, in each embodiment of the following description, the terms "first", "second", "third", and "fourth" are simply introduced to different components, and not be used to imply any correlation of these components. In addition, in order for concise explanation, thicknesses or dimensions of components in the drawings are provided in an exaggerated, omitted or sketchy manner, not for limiting the scope of this disclosure. Without affecting the effect and purpose that the present disclosure can produce and achieve, any modification of the structure, change of the proportional relationship, or adjustment of the size should still fall within the scope of the technical content of this disclosure.

Figure 2:
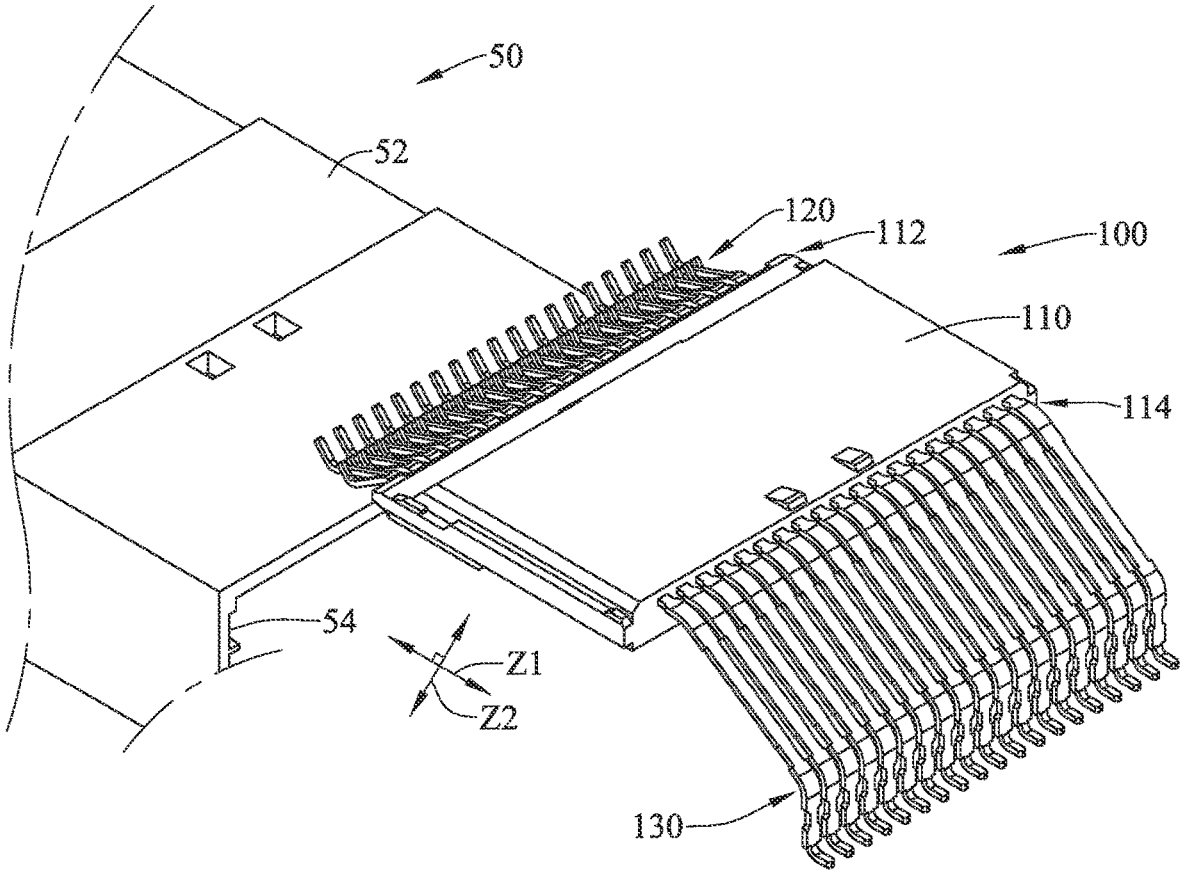
FIG. 2 is a schematic exploded view of FIG. 1.

Referring to FIG. 1 and FIG. 2, in this embodiment, the connector structure 50 includes an insulated housing 52 and a terminal assembly 100. The connector structure 50 as a whole is disposed on a circuit board (not shown in the figure). Though only one terminal assembly 100 is included in this embodiment, yet a typical high-frequency connector can be usually furnished with at least two terminal assemblies. In some particular application, a high-density connector may include four terminal assemblies. For example, in the QSFP DD (Quad Small Form-factor Pluggable Double Density) standard specifications, signal pads are provided to two opposite surfaces of a smaller circuit board (not shown in the figure) which may be a daughter board, and each said surface is generally furnished with two rows signal pads. Thus, four rows of signal pads can be provided by the daughter board in this application. Namely, this connector can provide more than four terminal assemblies, and the terminal assemblies are vertically stacked in a direction perpendicular to an insertion direction of the daughter board. Nevertheless, in this disclosure, though the connector structure 50 provided in this embodiment shows only one single terminal assembly 100, yet the skill in the art shall understand that this embodiment is only a simplified demonstrative example for a purpose of concise explanation, and practically the number of the terminal assemblies in the connector shall be determined according to real design requirements. By having the insulated housing 52 as an example, though it is made of an insulation materials and includes only a pair of receiving grooves 54 for a terminal assembly 100 to be inserted in, in an insertion direction Z1, yet the number of the receiving grooves 54 for the connector can be adjusted according to practical requirements. In the previous example of the QSFP DD connector, the insulated housing 52 can be furnished with two receiving grooves 54, and a plurality of terminal assemblies are vertically piled in an arrangement direction Z2 perpendicular to the insertion direction Z1 of the circuit board.

In this embodiment, the terminal assembly 100 includes an insulated shelter 110 and a plurality of pins 120, 130 fixed to the insulated shelter 110, and the pins 120 and the corresponding pins 130 are electrically connected. In this embodiment, each of the pins 120 is protruded from a first end 112 of the insulated shelter 110 so as to electrically connect the daughter board, and each of the pins 130 is protruded from a second end 114 of the insulated shelter 110 so as to electrically connect the corresponding circuit board, or mother board (not shown in the figure). In detail, the pins 120, 130 shown in the drawings of this disclosure are relevant to be attached to the surfaces of the circuit boards. However, the practical application of this disclosure is not limited to the aforesaid embodiment.

Figure 3:
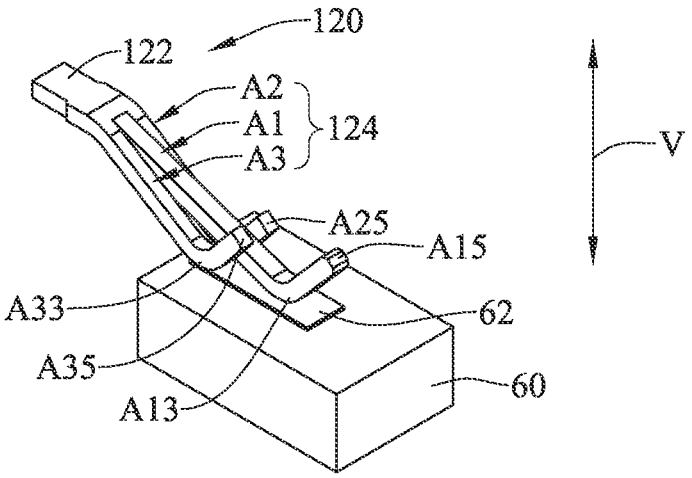
FIG. 3 demonstrates schematically an embodiment of the terminal assembly of the connector structure of FIG. 2.
Figure 4:
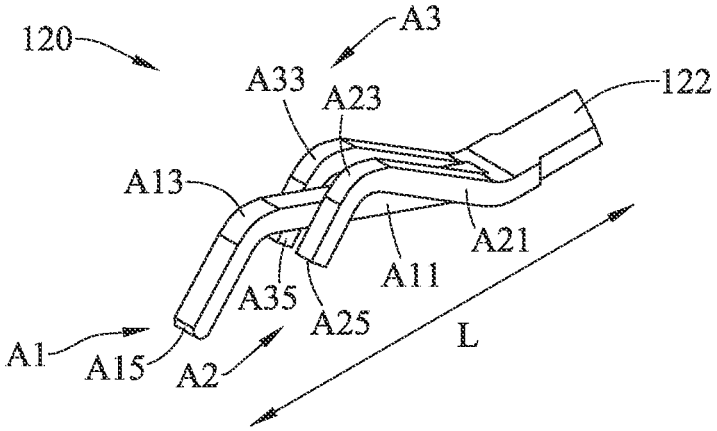
FIG. 4 shows schematically another view of the pin of FIG. 3.

As shown in FIG. 3 and FIG. 4, each of the pins 120 includes a pin body 122 and a protrusive portion 124 consisted of a first finger A1, a second finger A2 and a third finger A3. Each fingers A1, A2, A3 can be regarded as a cantilever section as shown in the drawings. Each of the first finger A1, the second finger A2 and the third finger A3 is protruded from the pin body 122. In detail, the pin body 122 is bent downward in a height direction V (approaching down toward the circuit board 60) and extended in a bifurcation manner to form the first finger A1, the second finger A2 and the third finger A3, in which the first finger A1 is disposed between the second finger A2 and the third finger A3. As shown in FIG. 3, in comparison with the second finger A2 and the third finger A3, the first finger A1 is protruded from the pin body 122 in a smaller bending angle, so that the first finger A1 would present a different position or staggered with respect to both the second finger A2 and the third finger A3 in a wiping direction (i.e., the extension direction L in FIG. 4). That is, while in a matching operation, the first finger A1 would provide a different wiping length in a wiping stroke to either wiping lengths of the second finger A2 and the third finger A3.

Figure 5:
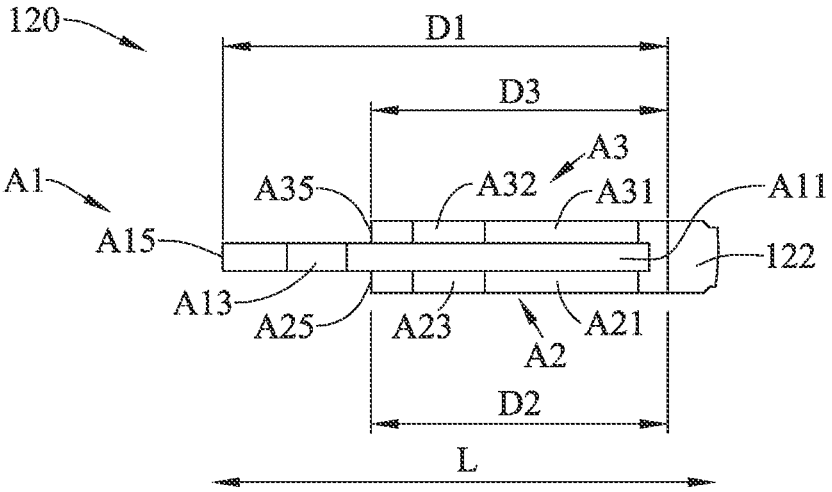
FIG. 5 is a schematic top view of FIG. 4.

The first finger A1 includes a first bending portion A11, a first contact portion A13 and a first end portion A15; the second finger A2 includes a second bending portion A21, a second contact portion A23 and a second end portion A25; and, the third finger A3 includes a third bending portion A31, a third contact portion A33 and a third end portion A35. Namely, in the extension direction L of the pin body 122 (i.e., the wiping direction for matching the pin 120 and the circuit board 60 in this embodiment), the first finger A1, the second finger A2 and the third finger A3 are individually extended to form staggered bending portions A11, A21, A31, staggered contact portions A13, A23, A33 and staggered end portions A15, A25, A35, respectively. In addition, each of the contact portions A13, A23, A33 is connected between the corresponding end portion A15, A25 or A35 and the corresponding bending portion A11, A21 or A31, respectively. In the height direction V, by having the pin body 122 as a reference, each of the end portions A15, A25, A35 and the corresponding contact portion A13, A23 or A33 are both lower than the pin body 122, and each of the end portions A15, A25, A35 is higher than the corresponding contact portion A13, A23 or A33, respectively. As such, the contact portions A13, A23, A33 are the lowest points of the first finger A1, the second finger A2 and the third finger A3, respectively. In particular, each of the contact portions A13, A23, A33 can be formed in an arc shape, a U shape or a V shape. In this embodiment, the three end portions A15, A25, A35 staggered to form at least two different distances to the common pin body 122. By having FIG. 5 as an example, there is a first distance D1 between the first end portion A15 of the first finger A1 and the pin body 122, there is a second distance D2 between the second end portion A25 of the second finger A2 and the pin body 122, and there is a third distance D3 between the third end portion A35 of the third finger A3 and the pin body 122. The first distance D1 is greater than each of the second distance D2 and the third distance D3, and the second distance D2 is equal to the third distance D3. In other words, in this embodiment, the extension length of the first finger A1 from the pin body 122 in the extension direction L is greater than that of the second finger A2 or the third finger A3. In other embodiments, the second distance D2 may be different to the third distance D3. Practically, these three lengths D1, D2, D3 of the protrusive portion 124 are determined mainly by design requirements. It shall be understood that, since the pins 120 at the same row may include different pins for transmitting high and low frequency signals, the aforesaid pin 120 structured to include the contact portions A13, A23, A33 can be used for transmitting the high-frequency signals, and pins for transmitting the low-frequency signals can be different.

Figure 6:
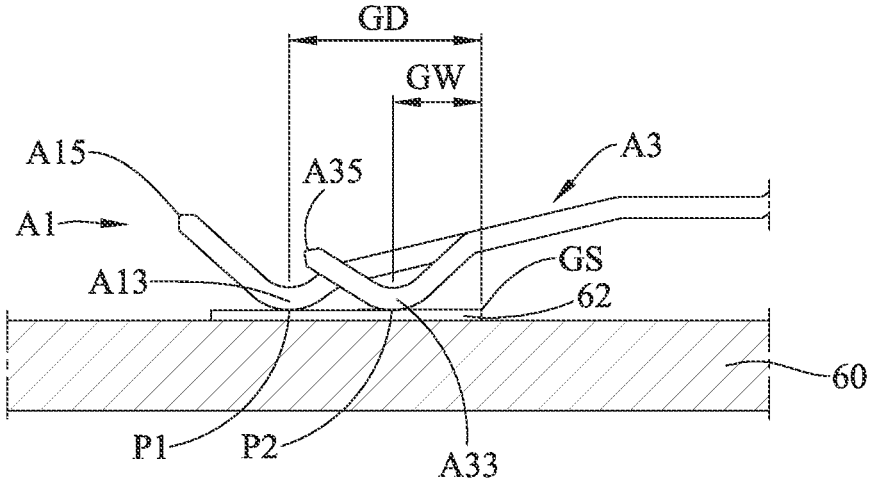
FIG. 6 is a schematic side view of FIG. 4.

In this embodiment, as shown in FIG. 3 and FIG. 6, while the first contact portion A13 of the first finger A1, the second contact portion A23 of the second finger A2, and the third contact portion A33 of the third finger A3 are individually utilized to match the same signal pad 62 of a daughter board 60 (while in wiping, the fingers A1, A2, A3 of each of the pins 120 would apply individually corresponding normal forces against the signal pad 62), the contact portions A13, A23, A33 are rested/contacted at different positions in a linear wiping direction on the same level surface of the signal pad 62, and also at different positions in the extension direction L. Namely, one single pin 120 would have multiple contact points to the signal pad 62, and these contact points are located at different positions in the extension direction L on the signal pad 62. As shown in FIG. 6, the signal pad 62 includes an initial contact line GS, a first contact position P1 and a second contact position P2, in which P1 and P2 are individually spaced from the first position GS by corresponding distances. The initial contact line GS is a collection of initial wiping positions for individual contact portions (A31, A33 in FIG. 6) of the pin 120 on the signal pad 62. The end wiping position on the signal pad 62 for the first contact portion A13 is the first contact position P1, and the end wiping position on the signal pad 62 for the third contact portion A33 is the second contact position P2. Similarly, though not shown in the figure, an end wiping position on the signal pad 62 for the second contact portion A23 can be a third contact position. This third contact position is different to each of the first contact position P1 and the second contact position P2 in the extension direction L shown in FIG. 4, but can be in the same line of the first contact position P1 or the second contact position P2. A distance GD is defined to be the distance on the signal pad 62 between the first contact position P1 and the initial contact line GS, and a distance GW is defined to be the distance on the signal pad 62 between the second contact position P2 and the initial contact line GS. Thereupon, the distance for the open (unsealed) end on the signal pad 62 is reduced to the distance GW from the distance GD, and thus the stub effect can be substantially suppressed. Also, possible environmental electromagnetic interference can be reduced, and signal integrity for the high-frequency signal path can be improved. It shall be explained that, in this embodiment, the same signal pad 62 on the circuit board 60 is utilized to contact the first contact portion A13 of the first finger A1, the second contact portion A23 of the second finger A2, and the third contact portion A33 of the third finger A3. However, in other embodiments, the signal pads can be provided to two opposite surfaces of the circuit board, and each of the signal pads can be arranged to electrically contact at least one contact portion of the terminal assembly (for example, the first contact portion A13 of the first finger A1, the second contact portion A23 of the second finger A2, and the third contact portion A33 of the third finger A3).

Figure 7:
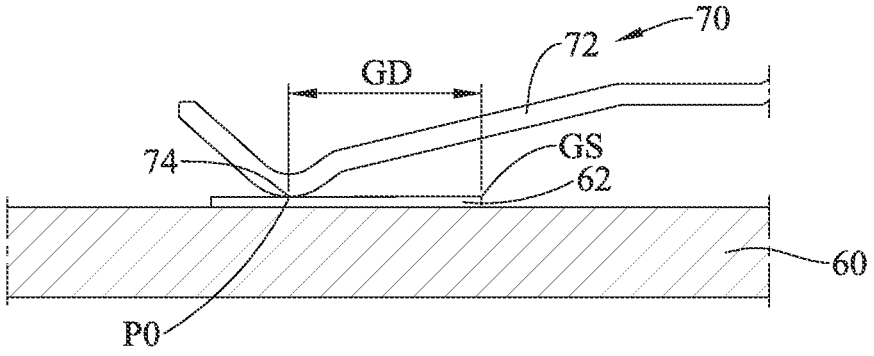
FIG. 7 (PRIOR ART)
FIG. 7 is a schematic side view of a conventional pin.

By having a conventional design shown in FIG. 7 as a reference, the conventional pin 70 has a connection section 72 and a contact portion 74 connected with the connection section 72. The contact portion 74 is corresponding to a contact position P0 on the signal pad 62. The contact position P0 is the end wiping position on the signal pad 62 for the contact portion 74. A distance GD, the wiping length for the conventional pin 70, is defined to be the distance on the signal pad 62 between the contact position P0 and the initial contact line GS. Since the signal pad 62 has a length spec, thus, while in signal transmission, a capacitance effect would reduce the impedance through the distance GD so as to induce a phenomenon of impedance discontinuity. Such a phenomenon would decrease the signal intensity while the signal is transmitted back and forth within this distance GD, and thus the stub effect is formed to reduce the signal integrity of the high-frequency signal transmitted through the pin itself.

Figure 8:
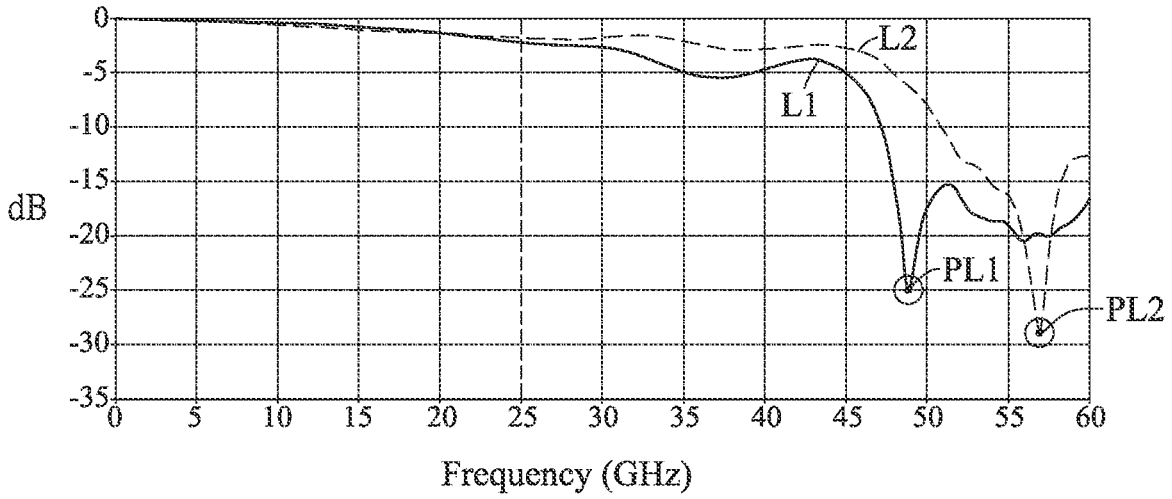
FIG. 8 is a gain plot of a simulation result in accordance with this disclosure.

As shown in FIG. 8, the unit for the horizontal axis is GHz, that for the vertical axis is dB, L1 is the simulation curve of insertion loss for sample 1 of FIG. 7, and L2 is the simulation curve of insertion loss for sample 2 of the connector structure of FIG. 6 in this disclosure. By analyzing simulation results of insertion loss, it is found in FIG. 8 that, for frequencies higher than 22 GHz, all the dBs for line L1 since 25 GHz would decay to −3 dB, and all exceed −5 dB from 35 GHz. On the other hand, the dBs of line L2 between 22 GHz and 35 GHz are kept within −3 db. Thus, in comparison at 22 GHz, this disclosure does lessen the stub effect and contribute to the integrity of signal transmission. In other words, high-frequency signal transmission through the pin 120 has less signal attenuation, and thus the signal transmission for frequencies above 22 GHz presents a significant improvement. For example, for any frequency below 40 GHz, the dB of line L2 is greater than that of line L1 (i.e., line L2 of this disclosure has less signal attenuation). Further, in line L1, the first resonance point PL1 occurs at about 48 GHz, while the second resonance point PL2 of line L2 is at about 57 GHz. Namely, the resonance point of this disclosure for high-frequency operations has been up shifted by about 10 GHz, which implies that the structure of FIG. 6 provides a wider operation range (0-57 GHz). Thereupon, the phenomenon of signal attenuation would be hard to happen for higher frequencies. Thus, according to this disclosure, the aforesaid energy-loss problem for high-frequency signal transmission can be substantially resolved, and thus frequency range and rate for signal transmission can be significantly improved by using the connector of this disclosure.

Figure 9:
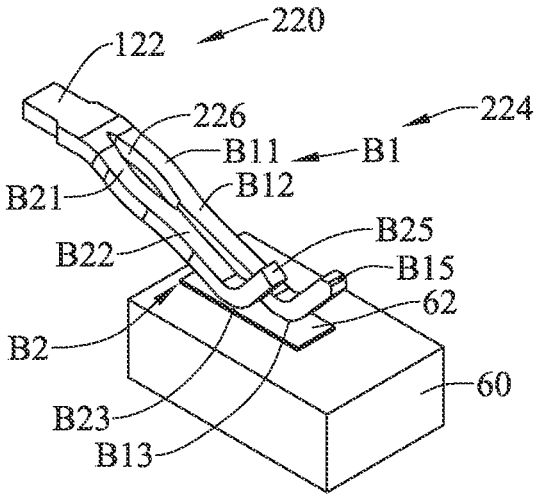
FIG. 9 demonstrates schematically another embodiment of the pin of the connector structure of FIG. 2.
Figure 10:
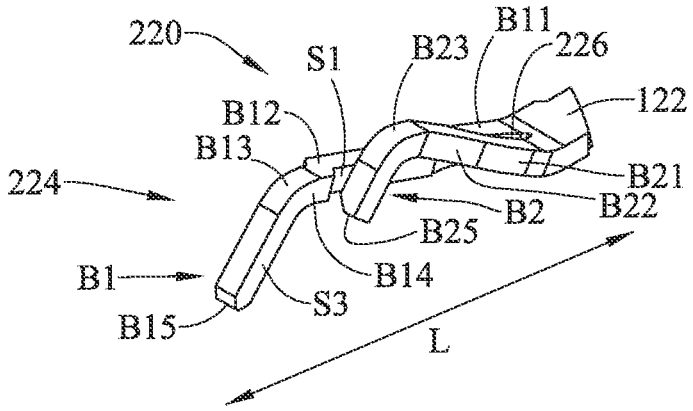
FIG. 10 shows schematically another view of the pin of FIG. 9.
Figure 11:
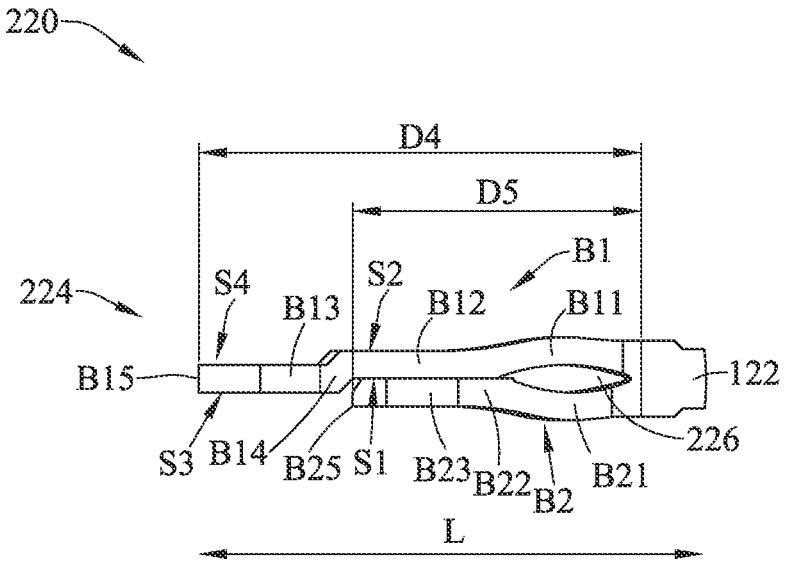
FIG. 11 is a schematic top view of FIG. 10.

Referring to FIG. 9 through FIG. 11, another embodiment of the pin of the connector structure of FIG. 2 is schematically shown. It shall be explained that, for a purpose of concise explanation, a pin 220 of FIG. 9 to FIG. 11 is used for replacing the aforesaid pin 120 of FIG. 3 to FIG. 6. As shown, the pin 220 includes a pin body 122 and a protrusive portion 224 consisted of a first finger B1 and a second finger B2 (i.e., cantilever sections). The first finger B1 includes a first preceding bending portion B11, a first following bending portion B12, a first contact portion B13, a first oblique section B14 and a first end portion B15. The second finger B2 includes a second preceding bending portion B21, a second following bending portion B22, a second contact portion B23 and a second end portion B25. In an extension direction L of the pin body 122, the first finger B1 and the second finger B2 are individually extended to orderly form the preceding bending portions B11, B21, the following bending portions B12, B22, the contact portions B13, B23 and the end portions B15, B25, respectively. In addition, in the first finger B1, the first oblique section B14 is connected between the first following bending portion B12 and the first contact portion B13. One end of the first preceding bending portion B11 is connected with the pin body 122, while another end thereof is connected with the first following bending portion B12. Then, the first following bending portion B12, the first oblique section B14, the first contact portion B13 and the first end portion B15 are orderly connected in a sequence. Similarly, one end of the second preceding bending portion B21 is connected with the pin body 122, while another end thereof is connected with the second following bending portion B22. Then, the second following bending portion B22, the second contact portion B23 and the second end portion B25 are orderly connected in a sequence. In this embodiment, as shown in FIG. 9 and FIG. 10, the contact portions B13, B23 are extended as the lowest ends of the first finger B1 and the second finger B2, respectively, and each of the contact portions B13, B23 can be shaped to be an arc shape, a U shape or a V shape. In addition, as shown in FIG. 11, a first distance D4 of the first finger B1 is defined as the distance measured from the first end portion B15 to the pin body 122, a second distance D5 of the second finger B2 is defined as the distance measured from the second end portion B25 to the pin body 122, and the first distance D4 is greater than the second distance D5. In addition, while the first contact portion B13 of the first finger B1 and the second contact portion B23 of the second finger B2 are extended downward to individually contact the signal pad 62 of the daughter board 60, the contact portions B13, B23 contact the signal pad 62 in the extension direction L at different positions. By providing two separate contact points B13, B23 to the same pin 220, then open ends at the signal pad 62 would be reduced so as to inhibit the stub effect.

In this embodiment, as shown in FIG. 11, in comparison with the first preceding bending portion B11 of the first finger B1 and the second preceding bending portion B21 of the second finger B2, the first following bending portion B12 of the first finger B1 and the second following bending portion B22 of the second finger B2 are individually extended inward so as to generate an aperture 226 between the first preceding bending portion B11 of the first finger B1 and the second preceding bending portion B21 of the second finger B2. As shown, the aperture 226 is formed by close to the pin body 122. In addition, in comparison with a position of the first following bending portion B12 of the first finger B1, the contact portion B13 is extended further inward so as to form a first oblique section B14 between the first contact portion B13 and the first following bending portion B12. Namely, the first offset section B14 extends further inward (i.e., toward the second finger B2) from the first following bending portion B12, such that a slope surface is generated between the first surface S1 (i.e. a sidewall of the first following bending portion B12) and the third surface S3 (constituted by sidewalls of the contact portion B13 and the first offset section B14). Thereupon, as shown in FIG. 11, the segment of the first finger B1 including the first end portion B15, the first offset section B14 and the first contact portion B13 is not neighbored by the second finger B2. Similarly, another slope surface (i.e., the slope surface means the distance, in the vertical direction perpendicular to the extension direction L, between the first surface S1 and the third surface S3) is generated between the second surface S2 (i.e., a sidewall of the first following bending portion B12) and the fourth surface S4 (constituted by sidewalls of the first end portion B15 and the first contact portion B13).

Figure 12:
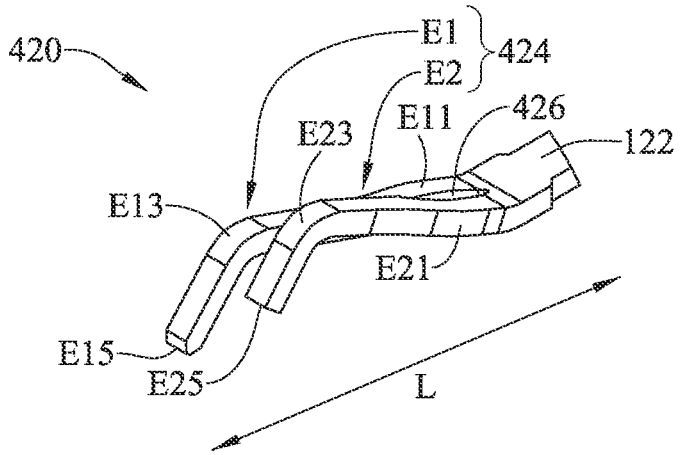
FIG. 12 demonstrates schematically a further embodiment of the pin of the connector structure of FIG. 2.
Figure 13:
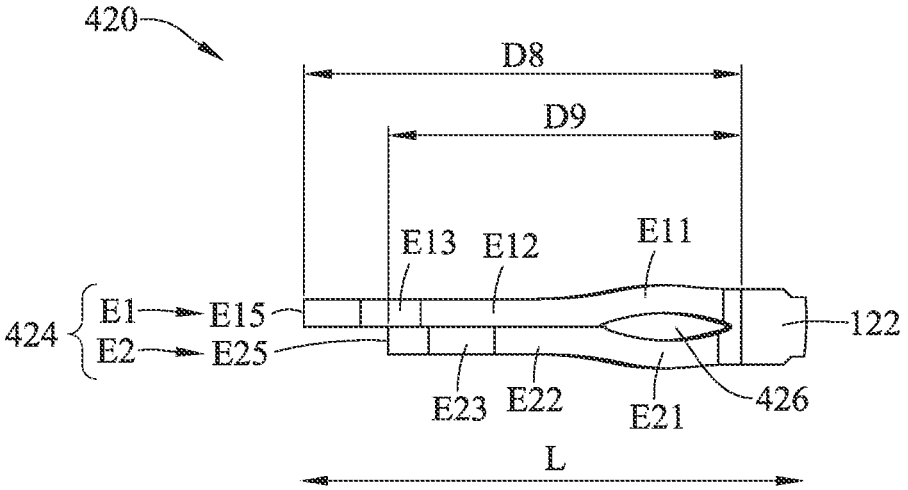
FIG. 13 is a schematic top view of FIG. 12.

Referring to FIG. 12 and FIG. 13, a further embodiment of the pin of the connector structure of FIG. 2 is schematically shown. It shall be explained that, for a purpose of concise explanation, a pin 420 of FIG. 12 and FIG. 13 is used for replacing the aforesaid pin 120 of FIG. 3 to FIG. 6. As shown, the pin 420 includes a pin body 122 and a protrusive portion 424 consisted of a first finger E1 (i.e., a cantilever section) and a second finger E2. The first finger E1 includes a first preceding bending portion E11, a first following bending portion E12, a first contact portion E13 and a first end portion E15. The second finger E2 includes a second preceding bending portion E21, a second following bending portion E22, a second contact portion E23 and a second end portion E25.

In an extension direction L of the pin body 122, the first finger E1 and the second finger E2 are individually extended to orderly form the preceding bending portions E11, E21, the following bending portions E12, E22, the contact portions E13, E23 and the end portions E15, E25, respectively. As shown in FIG. 13, a first distance D8 of the first finger E1 is defined as the distance from the first end portion E15 to the pin body 122, a second distance D9 of the second finger E2 is defined as the distance from the second end portion E25 to the pin body 122, and the first finger E1 and the second finger E2 do not contact to each other. In addition, the difference between this embodiment and that shown in FIG. 9 to FIG. 11 is that: neither an oblique section nor a slope surface exists between the first end portion E15 and the first contact portion E13 of the first finger E1. Similarly, neither an offset section nor a slope surface exists between the second end portion E25 and the second contact portion E23 of the second finger E2. However, an aperture 426 is formed between the first preceding bending portion E11 of the first finger E1 and the second preceding bending portion E21 of the second finger E2, and the aperture 426 is located by closing to the pin body 122. In the manufacturing art, the pin 120 is formed by protruding a plurality of protrusive portions (such as the first finger E1 and the second finger E2 shown in FIG. 12 and FIG. 13) from the pin body 122. Thus, if the pin 120 produced by a general sheet metal stamping technology, then the aperture 426 is there to help in tearing the pins 120 for distance positioning.

Figure 14:
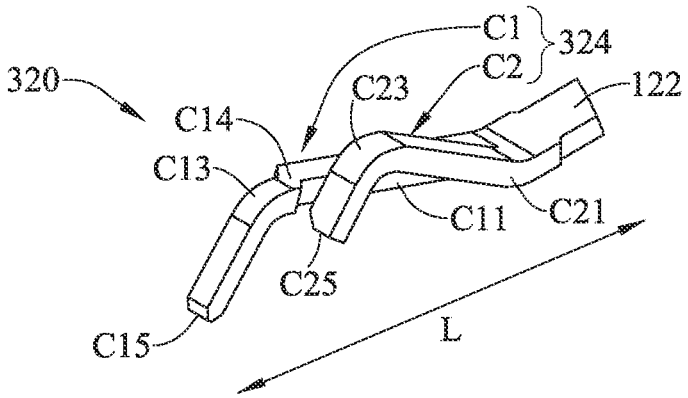
FIG. 14 demonstrates schematically one more embodiment of the pin of the connector structure of FIG. 2.
Figure 15:
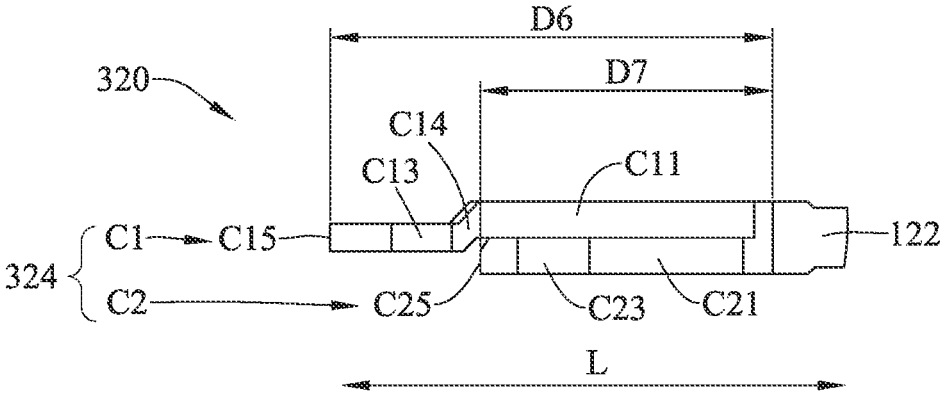
FIG. 15 is a schematic top view of FIG. 14.

Referring to FIG. 14 and FIG. 15, one more embodiment of the pin of the connector structure of FIG. 2 is schematically shown. It shall be explained that, for a purpose of concise explanation, a pin 320 of FIG. 14 and FIG. 15 is used for replacing the aforesaid pin 120 of FIG. 3 to FIG. 6. As shown, the pin 320 includes a pin body 122 and a protrusive portion 324 consisted of a first finger C1 and a second finger C2 (i.e., cantilever sections). The first finger C1 includes a first bending portion C11, a first oblique section C14, a first contact portion C13 and a first end portion C15. The second finger C2 includes a second bending portion C21, a second contact portion C23 and a second end portion C25. In an extension direction L of the pin body 122, the first finger C1 and the second finger C2 are individually extended to orderly form the bending portions C11, C21, the contact portions C13, C23 and the end portions C15, C25, respectively. As shown in FIG. 15, a first distance D6 of the first finger C1 is defined as the distance from the first end portion C15 to the pin body 122, a second distance D7 is defined as the distance from the second end portion C25 to the pin body 122, and the first distance D6 is greater than the second distance D7. In addition, this embodiment (FIG. 14, FIG. 15) and the aforesaid embodiment shown in FIG. 9 to FIG. 11 are the same in that the offset section C14 exists between the first contact portion C13 of the first finger C1 and the first bending portion C11 thereof. The first end portion C15, the first contact portion C13 are not neighbored to part of the second finger C2, and the first finger C1 and the second finger C2 are not to contact each other. On the other hand, the difference between this embodiment (FIG. 14, FIG. 15) and the aforesaid embodiment shown in FIG. 9 to FIG. 11 is that: no aperture exists between the first bending portion C11 of the first finger C1 and the second bending portion C21 of the second finger C2, but the first bending portion C11 of the first finger C1 and the second bending portion C21 of the second finger C2 are neighbored to each other.

In each of the aforesaid embodiments, a daughter board is prepared for mating with the connector. Except for providing surfaces to dispose thereon a plurality of signal pads, the daughter board is generally a low profile circuit board, and the daughter board is furnished thereon relevant electronic circuits to electrically connect each of the signal pads. However, similar to said daughter board, a complement connector having a tongue plate may have a plurality of pins arranged on surfaces of the tongue plates. Here, the tongue plate is made of a low profile insulation material, and signal pads may be replaced by terminals, each having a stiffened terminals contact portion of the complement connector, which are deployed on surfaces of the tongue plate. Therefore, each of the terminals on the tongue plate is similar to said each of the signal pads on the daughter board in any of the aforesaid embodiments. In addition, the low profile feature of the tongue plate of the complement connector is similar to the low profile feature of the aforesaid daughter board.

In summary, in the terminal components of the connector and the same connector structure provided by this disclosure, one single pin provides different contact portions to generate different contact positions on the same signal pad in the wiping direction while the connector having the pin is matched with the daughter board or the pairing connector. With two or three contact portions on a single pin, the open (unsealed) ends on the signal pad can be reduced, such that the stub effect in the signal transmission path can be suppressed, the problem of energy transmission loss can be improved, and the transmission bandwidth and rate for the connector can be enhanced.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A connector structure, comprising:

an insulated housing, including at least one receiving groove for receiving a daughter board, the daughter circuit board having a surface furnished thereon with a plurality of signal pads; and at least one terminal assembly, each of the at least one terminal assembly being disposed at least partially within the insulated housing and including:

an insulated shelter; and a plurality of pins, fixed to the insulated shelter, each of the plurality of pins including:

a pin body; and at least two protrusive portions, connected individually with the pin body, each of the at least two protrusive portions having a contact portion to contact one of the plurality of signal pads on the daughter board, wherein the contact portions of each of the plurality of pins are contacted at the same signal pad corresponding thereto and are contacted at different positions on the same level surface of the same signal pad corresponding thereto.

2. The connector structure of claim 1, wherein each of the at least two protrusive portions includes a bending portion and an end portion, the bending portion is connected between the pin body and the contact portion, and the contact portion is connected between the end portion and the bending portion.

3. The connector structure of claim 2, wherein the end portion and the contact portion connected with the end portion are both lower than the pin body, and the end portion is higher than the contact portion.

4. The connector structure of claim 2, wherein each of the plurality of pins includes an aperture formed between the at least two protrusive portions and disposed close to the pin body.

5. A terminal component of a connector, the connector being applied to mate with a daughter board, the daughter board having a surface furnished thereon with a plurality of signal pads, comprising:

an insulated shelter; and a plurality of pins, fixed individually to the insulated shelter, each of the plurality of pins including:

a pin body; and at least two protrusive portions, connected individually with the pin body, each of the at least two protrusive portions having a contact portion to contact one of the plurality of signal pads on the daughter board, wherein the contact portions of each of the plurality of pins are contacted at the same signal pad corresponding thereto and are contacted at different positions on the same level surface of the same signal pad corresponding thereto.

6. The terminal component of a connector of claim 5, wherein each of the at least two protrusive portions includes a bending portion and an end portion, the bending portion is connected between the pin body and the contact portion, and the contact portion is connected between the end portion and the bending portion.

7. A terminal component of a connector, the connector being applied to match a complement connector, the complement connector having a surface furnished thereon with a plurality of signal pads, comprising:

an insulated shelter; and a plurality of pins, fixed individually to the insulated shelter, each of the plurality of pins including:

a pin body; and at least two protrusive portions, connected individually with the pin body, each of the at least two protrusive portions having a contact portion to contact one of the plurality of signal pads on the complement connector, wherein the contact portions of each of the plurality of pins are contacted at the same signal pad corresponding thereto and are contacted at different positions on the same level surface of the same signal pad corresponding thereto.

* * * * *